United States Patent [19]

Maes et al.

[11] Patent Number: 4,926,576

[45] Date of Patent: May 22, 1990

[54] MOUNTING DEVICE ADAPTABLE ON A WEAPON

[75] Inventors: Félix V. Maes, Barchon; Michel Baikrich, Tilff, both of Belgium

[73] Assignee: ARSOC S.P.R.L., Barchon, Belgium

[21] Appl. No.: 330,137

[22] Filed: Aug. 9, 1988

[30] Foreign Application Priority Data

Aug. 13, 1987 [BE] Belgium ..... 08700903

[51] Int. Cl.[5] ..... F41G 1/38

[52] U.S. Cl. ..... 42/101; 42/103; 33/250

[58] Field of Search ..... 42/100, 101, 103, 98; 33/250; 403/344; 24/516

[56] References Cited

U.S. PATENT DOCUMENTS

| | | | |
|---|---|---|---|
| 3,877,166 | 4/1975 | Ward | 42/101 |
| 4,021,954 | 5/1977 | Crawford | 33/250 |
| 4,295,289 | 10/1981 | Snyder | 42/103 |

FOREIGN PATENT DOCUMENTS

| | | | |
|---|---|---|---|
| 1279511 | 10/1968 | Fed. Rep. of Germany | 33/250 |
| 3241753 | 5/1984 | Fed. Rep. of Germany | 33/250 |

*Primary Examiner*—Charles T. Jordan
*Assistant Examiner*—Michael J. Carone
*Attorney, Agent, or Firm*—Charles F. Meroni, Jr.

[57] ABSTRACT

A mounting device for fixing an instrument onto a weapon. The device comprises a body that is adapted to carry an instrument. The body has a surface featuring at least an attachment edge or surface which is intended to mate with the surface of one side of the weapon. A pivotal lateral leg is mounted on the body in order to mate with the surface of the weapon on the side which is opposite to the one where the attachment edge or surface fits. The pivotal lateral leg has a cut for allowing a pressure shoulder. A locking means is mounted on the body in order to keep the pivotal lateral leg in a state of pressure on the weapon. The locking means is comprised of a lever jointed on a pivot mounted on the pivotal lateral leg, the lever has surface to mate with a pressure shoulder arranged on the body when the lever is in the clamping position. The surfaces and the pressure shoulder are so shaped that when the locking lever is in clamping position, the pressure shoulder exerts a pressure on the surfaces that the lever is caused to pivot thereby to maintain the pivotal lateral leg in clamping engagement with the weapon.

15 Claims, 2 Drawing Sheets

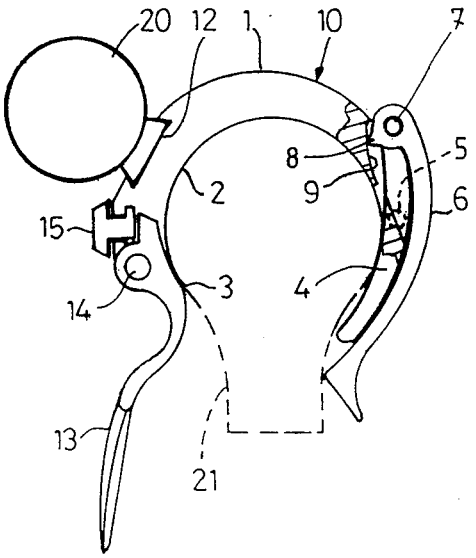
FIG. 1
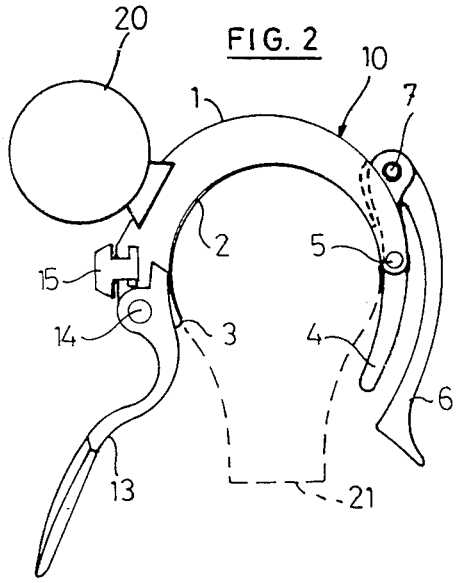
FIG. 2
FIG. 3
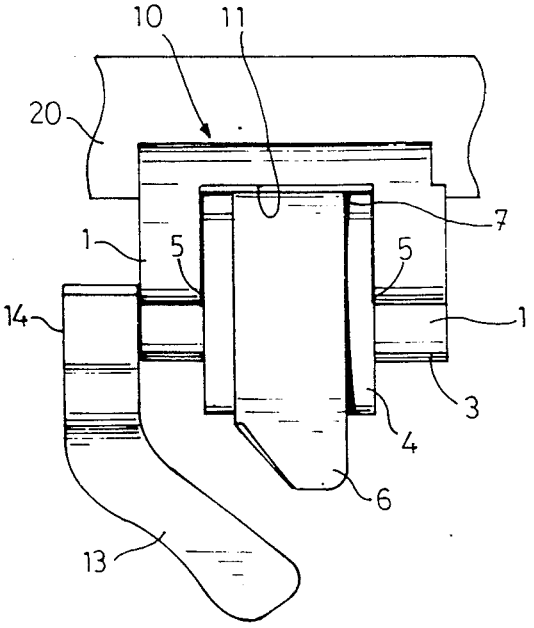

MOUNTING DEVICE ADAPTABLE ON A WEAPON

BACKGROUND OF THE INVENTION

This invention relates to a mounting device for fixing an instrument on a weapon, for instance a marker or pointer, a view finder or the like.

All the prior art devices for fixing an instrument on a weapon include rather intricate spring arrangements for clamping the device onto the weapon.

The object of the invention is to allow the mounting of any instrument on a weapon, in a simple, rapid and secure manner, and by means of a device which is easily adaptable to any type of weapon.

SUMMARY OF THE INVENTION

According to the invention there is provided a mounting device comprising a body adapted to carry an instrument, said body having an incurved bearing surface featuring at least an attachment edge or surface intended to cooperate with the surface of the weapon on one side of same; pivotal lateral leg means mounted on the body in order to cooperate with the surface of the weapon on the side thereof, which is opposite to the one where said attachment edge or surface fits, and locking means mounted on said body so as to be capable of keeping said pivotal lateral leg means in a state of pressure on the weapon, whereby when the pivotal lateral leg means is in engagement with the surface of the weapon, said body is rigidly fixed onto the weapon through clamping engagement on the opposite sides of the weapon.

In a preferred embodiment the locking means consists of a lever jointed round a pivot mounted on said pivotal lateral leg means, said lever having a projecting flange for cooperating with a pressure shoulder arranged on said body when said lever is in the clamping position, said projecting flange and said pressure shoulder being so shaped that, when the locking lever is in clamping position, the pressure shoulder exerts pressure on said flange such that the lever is caused to pivot thereby to maintain said pivotal lateral leg means in clamping engagement with the weapon.

Other particulars of the invention are described in the appended claims.

An embodiment by way of example of a mounting device according to the invention is illustrated in the appended drawings.

BRIEF DESCRIPTION OF THE DRAWINGS

FIG. 1 shows the frontal view of a mounting device located and fixed onto a weapon, said device carrying a miniature laser pointer.

FIG. 2 shows the mounting device as in FIG. 1 located on the weapon, but not yet fixed onto it.

FIG. 3 is a lateral view of the mounting device shown in FIG. 1.

DESCRIPTION OF AN EXEMPLARY EMBODIMENT

Figure 4:
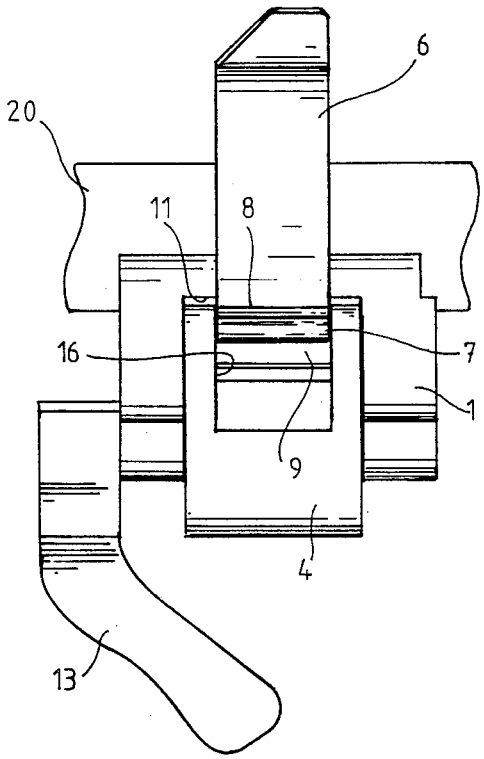
FIG. 4 is a lateral view similar to FIG. 3, but showing the locking lever in standing up position.

FIG. 1 shows the mounting device 10 carrying for instance a miniature laser pointer 20 and the device 10 is fixed onto a weapon having an exemplary outline as shown in frontal view represented by the dotted line labelled 21. It will be appreciated that the device according to the invention can be adapted to any type of weapon of whatever outline. FIG. 2 shows the mounting device located on the weapon, but not yet fixed onto it.

The device 1 comprises an incurved body 1 having a bearing surface 2 for resting onto a weapon. At one lateral end of the incurved surface 2 the body 1 features an attachment edge or surface 3 intended to cooperate with the surface of the weapon onto which the body 1 is to be mounted, on one side of said weapon.

At the other lateral end of body 1 is mounted a pivotal lateral leg 4. In the embodiment illustrated in the drawings the lateral leg 4 is mounted on two pivots 5 fixed to the body 1. As shown particularly in FIGS. 3 and 4, the pivots 5 are fixed in a cut or a recess 11 made in body 1 and the upper portion of the lateral leg 4 fits at least partially in said recess 11. The pivots 5 define a pivot axis for the lateral leg 4.

When the mounting device is located on a weapon (FIG. 2), the lateral leg 4 is suspended slack from the pivots 5 and the lower portion thereof is away from the surface of the weapon. In order to tighten the leg 4 on the weapon and thereby clamping the body 1 onto the weapon, there is provided clamping and locking means to exert and keep a pressure on the pivotal lateral leg 4. In the exemplary embodiment illustrated in the drawings, said locking means comprises a locking lever 6 mounted round a pivot 7 fixed to the upper end portion of the lateral leg 4. The lever 6 has a projection or pressure flange 8 (shown in the cut-away portion of FIG. 1) shaped to cooperate with a pressure shoulder 9 formed on the body 1 when the lever 6 is in the clamping position. The pressure flange 8 and the pressure shoulder 9 are so shaped, in accordance with this invention, that when the locking lever 6 is pivoted down to the weapon, that is onto the lateral leg 4, the pressure shoulder 9 exerts a pressure on flange 8 thereby to cause the lever 6 to pivot so as to apply and keep a pressure onto the lateral leg 4, especially onto the lower portion of leg 4, whereby said leg 4 is kept in tighten engagement with the weapon. In the exemplary embodiment illustrated in the drawings the pressure flange 8 is allowed to cooperate with the pressure shoulder 9 through a cut 16 made in the leg 4 as shown in particular in FIG. 4 which depicts the mounting device of the invention with the locking lever 6 in standing up position.

The mounting device according to this invention can be fixed on a weapon in a very simple manner. When the body 1 is located on the weapon, the locking lever 6 is pivoted down to the weapon whereby the leg 4 is pressed down in engagement with the weapon. The support 10 is hereby rigidly secured to the weapon by tightening and clamping under pressure of both its lateral ends to the opposite sides of the weapon. It can be appreciated from the exemplary drawings appended hereto that the pivotal lateral leg 4 has advantageously a width that provides a substantial engagement surface for cooperating with the surface of the weapon onto which the device can be mounted.

The tightening pressure exerted by the locking lever 6 on the leg 4 is maintained constant thanks to the shape of the pressure flange 8 which is preferably shaped so as to feature an upward nose whereby any tendency of the lever 6 to pivot away from the weapon when it is in the clamping position (FIG. 1) would cause the pressure exerted by said pressure shoulder 9 to increase. In this manner, any tendency of the leg 4 to pivot away from the weapon and to disengage from the weapon would automatically be counteracted by an increase in pressure on leg 4 and an improved clamping effect.

The arrangement according to the invention has the advantage that the pressing down, clamping and locking functions can be carried out in one single operation and one single action. A further advantage is that the mounting device can be adapted on any type of weapon while assuring a secure mounting and fixation. Yet another advantage of this arrangement is that it is simple and robust for it does not use any spring member.

In the embodiment illustrated in FIGS. 1 and 2 the external surface of the body 1 features a trapezoidal shaped groove 12 for the fixing of a laser pointer 20 in an angular position staggered with reference to the vertical axial plane of the weapon 21, allowing the view finding device of the weapon to be free (the view finding axle is located in the vertical axial plane). A control lever 13 is mounted on the body 1, said lever revolving round an axle 14 which extends parallel to the axis of the pointer 20. The lever 13 serves to activate a contactor (not shown) turning on a laser cell in order to produce a laser beam. The lever 13 has an incurved shape to extend on a side of the weapon 21 so as to be capable of being operated with one hand and at the same time as the weapon is fired. Lever 13 can be locked by a bolt 15 in order to avoid unwanted turning on of the laser cell.

Although there has been described hereinbefore one particular embodiment in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

We claim:

1. A mounting device for fixing an instrument or accessory onto a weapon, comprising a body adapted to carry an instrument, said body having a surface featuring at least an attachment edge or surface intended to mate with the surface of one side of the weapon, a pivotal lateral leg mounted on the body in order to mate with the surface of the weapon on the side which is opposite to the one where said attachment edge or surface fits, said pivotal lateral leg having a cut allowing for a pressure shoulder, and a locking means mounted on said body in order to keep said pivotal lateral leg in a state of pressure on the weapon, said locking means consisting of a lever jointed on a pivot mounted on said pivotal lateral leg, said lever having surfaces to mate with the pressure shoulder arranged on said body when said lever is in a clamping position, said surfaces and said pressure shoulder being so shaped that, when the locking lever is in clamping position, the pressure shoulder exerts such a pressure on said surfaces that the lever is caused to pivot thereby to maintain said pivotal lateral leg in clamping engagement with the weapon, thereby when the pivotal lateral leg is in engagement with the surface of the weapon, said body is rigidly fixed onto the weapon through clamping engagement on the opposite sides of the weapon.

2. A device according to claim 1, wherein said surface is so designed that any tendency of the locking lever to pivot away from the weapon when said lever is in the clamping position causes the pressure exerted by said pressure shoulder on the projection means to increase.

3. A device according to claim 1, wherein the pivot for said locking lever is fixed on the upper portion of said lateral leg.

4. A device according to claim 1, wherein the lever has a curved shape with an arm which is laterally offset relative to the vertical axial plane of the casing.

5. A device according to claim 1, wherein the lateral leg is mounted on pivot axles fixed on said body in a recess made in said body.

6. A device according to claim 5, wherein the upper portion of the pivotal lateral leg fits at least partially in said recess.

7. A device according to claim 1, provided with a lever mounted so as to be pivotable around a pivot fixed on the body and extending parallel to the axis of said instrument, the lever having an end to actuate a contactor means, when it is in the pivoted position.

8. A mounting device for fixing an instrument onto a weapon, comprising a body adapted to carry an instrument, said body having an incurved bearing surface featuring at least an attachment edge or surface intended to cooperate with the surface of the weapon on one side of same, pivotal lateral leg means mounted on the body in order to cooperate with the surface of the weapon on the side thereof, which is opposite to the one where said attachment edge or surface fits, and locking means mounted on said body so as to be capable of keeping said pivotal lateral leg means in a state of pressure on the weapon, with the surface of the weapon, said body is rigidly fixed onto the weapon through clamping engagement on the opposite sides of the weapon, the locking means consists of a lever jointed round a pivot mounted on said pivotal lateral leg means said lever having projection means for cooperating with a pressure shoulder arranged on said body when said lever is in a clamping position, said projection means and said pressure shoulder being so shaped that, when the locking lever is in the clamping position, the pressure shoulder exerts pressure on said projection means such that the lever is caused to pivot thereby to maintain said pivotal lateral leg means in clamping engagement with the weapon, wherein the pivotal lateral leg means having a cut for allowing the end of said projection means to cooperate with said pressure shoulder.

9. A device according to claim 8, wherein said bearing surface is so designed that any tendency of the locking lever to pivot away from the weapon when said lever is in the clamping position causes the pressure exerted by said pressure shoulder on the projection means to increase.

10. A device according to claim 8, wherein the pivot for said locking lever is fixed on the upper portion of said pivotal lateral leg.

11. A device according to claim 8, wherein the lever has a curved shape with an arm which is laterally offset relative to the vertical axial plane of the body.

12. A device according to claim 8, wherein the pivotal lateral leg means comprises a leg which is mounted on pivot axles fixed on said body in a recess made in the body.

13. A device according to claim 12, wherein the upper portion of the pivotal lateral leg means fits at least partially in said recess.

14. A device according to claim 8, wherein said is lever mounted so as to be pivotable around a pivot fixed on the body and which extends parallel to the axis of said instrument, the lever having an end to actuate a contactor means, when it is in the pivoted position.

15. A mounting device for fixing an instrument onto a weapon, comprising a body adapted to carry an instrument, said body having an incurved bearing surface featuring at least an attachment edge or surface intended to cooperate with the surface of the weapon on one side of same, pivotal lateral leg means mounted on the body in order to cooperate with the surface of the weapon on the side thereof, which is opposite to the one where said attachment edge or surface fits, and locking means mounted on said body so as to be capable of keeping said pivotal lateral leg means in a state of pressure on the weapon, whereby when the pivotal lateral leg means is in engagement with the surface of the weapon, said body is rigidly fixed onto the weapon through clamping engagement on the opposite sides of the weapon, a pivot axle fixed on the body, the body having a control lever mounted for swinging round said pivot axle so that, when being operated, the control lever actuates a contactor controlling the instrument fixed on said body, and wherein the body carries a bolt for blocking the control lever and preventing accidental swinging of said lever.

* * * * *